United States Patent [19]

Becker

[11] 4,434,337

[45] Feb. 28, 1984

[54] MERCURY ELECTRODE SWITCH

[75] Inventor: Otto Becker, Nuremberg, Fed. Rep. of Germany

[73] Assignee: W. Günther GmbH, Nuremberg, Fed. Rep. of Germany

[21] Appl. No.: 276,923

[22] Filed: Jun. 24, 1981

[30] Foreign Application Priority Data

Jun. 26, 1980 [DE] Fed. Rep. of Germany ... 8016981[U]

[51] Int. Cl.[3] ..... H01H 29/22

[52] U.S. Cl. ..... 200/220; 200/52 A; 200/61.47; 200/61.52; 200/153 A; 200/193; 200/229

[58] Field of Search ..... 200/182, 220, 221, 193, 200/186, 229, 33 A, 67 MS, 52 A, 61.47, 61.52, 200/153 A

[56] References Cited

U.S. PATENT DOCUMENTS

| | | | |
|---|---|---|---|
| 1,820,063 | 8/1931 | Geiler | 200/229 X |
| 2,232,626 | 2/1941 | Olson | 200/229 |
| 2,583,434 | 1/1952 | Meyer | 200/186 X |
| 2,929,889 | 3/1960 | Efther | 200/191 X |
| 4,282,412 | 8/1981 | Florin | 200/220 X |

FOREIGN PATENT DOCUMENTS

| | | |
|---|---|---|
| 22146 | 9/1982 | European Pat. Off. . |
| 1018551 | 10/1957 | Fed. Rep. of Germany . |
| 2136428 | 10/1974 | Fed. Rep. of Germany . |
| 2172208 | 9/1973 | France . |

*Primary Examiner*—John W. Shepperd
*Assistant Examiner*—Renee Kidorf
*Attorney, Agent, or Firm*—Spencer & Frank

[57] ABSTRACT

In a mercury switch composed of a closed tubular glass envelope and at least one pair of electrodes extending through one end of the envelope and presenting terminals located within the region enclosed by the envelope and adjacent the one end thereof, the envelope is formed to have two indentations located opposite one another, spaced from the ends of the envelope, and spaced at a greater distance than the terminals from the one end, the indentations projecting toward one another to define, within the region enclosed by the envelope, a gap for the passage of mercury between the ends of such region.

6 Claims, 3 Drawing Figures

MERCURY ELECTRODE SWITCH

BACKGROUND OF THE INVENTION

The present invention relates to a mercury electrode switch having a tubular glass housing which is closed on all sides and into one end of which are fused at least one pair of electrodes, the glass housing being indented at a distance from the inside ends of the electrodes.

Mercury electrode switches of this type are known. Such switches, without the indented structure, are disclosed in German Patent No. 2,136,428. Such mercury elecrode switches serve to switch electrical currents, with the switching process being initiated by a tilting movement of the switch. If the switch is tilted in such a way that the mass of mercury in the interior of the glass housing contacts the two electrodes, the circuit is closed, i.e. the switch is on. If the switch is tilted in such a way that the mercury flows away from the electrodes and collects at another location, for example at the opposite end of the glass housing, the switch is off and the circuit is opened.

In view of the high mobility of the mercury, only very small angles with respect to the horizontal position are required to initiate the switching process. The difference in the positions of the switch between the minimum tilt at which it attains its "ON" position, on the one hand, and the minimum tilt at which it attains its "OFF" to position, on the other hand, a difference which is measured in angular degrees, is called the switching hysteresis. In the conventional, unrecessed, mercury electrode switches this angle is only a few angular degrees.

In some cases it is desired to increase the switching hysteresis. For such cases it is known to indent the glass housing at a distance from the inside ends of the electrodes. The switch must then be installed in such a manner that its recess comes to lie at the bottom. The recessing considerably increases the switching hysteresis since the mass of mercury must flow over the obstruction formed by the recess to go from the one end of the switch, the end without the electrodes to the other end of the switch equipped with the electrodes. Correspondingly large is the opposite tilt angle which the switch must traverse for the mercury to flow away from the inside ends of the electrodes in order to open the circuit.

The known recessed mercury electrode switches have the drawback that their housing recesses can become effective only if the switch is installed in a certain position. This cannot always be accomplished during installation of the switches in the devices to be switched so that rejects are unavoidable. But even if the switch is installed in the correct position, the instrument equipped with such a switch cannot operate properly if the instrument itself is placed in a position other than the one intended by its designer.

In order to provide position independent, recessed mercury electrode switches it is known to equip the glass housing of the switch with a recess that covers the entire circumference, i.e. an annular constriction. Such mercury electrode switches have not found commercial acceptance since it has happened again and again that the mass of mercury becomes stuck in the constricted portion of the glass housing. This problem occurs with particular frequency if the switch is filled with a protective gas. Mercury electrode switches with such complete circumferential constriction are therefore designed with preference as vacuum switches. But even with such constricted vacuum switches, the mercury cannot be positively prevented from getting stuck in the constricted section.

SUMMARY OF THE INVENTION

It is an object of the present invention to provide a mercury electrode switch which can be operated substantially independently of its position and whose operability is assured at least in two different installation positions.

The above and other objects are achieved, according to the invention, in a mercury switch composed of a closed tubular glass envelope and at least one pair of electrodes extending through one end of the envelope and presenting terminals located within the region enclosed by the envelope and adjacent the one end thereof, by forming the envelope to have two indentations located opposite one another, spaced from the ends of the envelope, and spaced at a greater distance than the terminals from the one end, the indentations projecting toward one another to define, within the region enclosed by the envelope, a gap for the passage of mercury between the ends of such region.

The two recesses, or indentations, preferably have an oval outline, when projected onto a plane passing between the two indentations, with the smaller diameter of the outline extending between the edges of the nonconstricted portions of the glass housing. Each notch has the shape of a trough, and the sloping faces of the two troughs all preferably have the same pitch.

The mercury electrode switch according to the invention can be designed, as is known for switches of this type, as simple on-off switches. In this case, the switch has two juxtaposed electrodes, i.e. a pair of electrodes at one end of the housing. However, it is also possible to design the switch as a reversal switch in which case the other housing end must also be equipped with a pair of electrodes.

DESCRIPTION OF THE PREFERRED EMBODIMENTS

Figure 1:
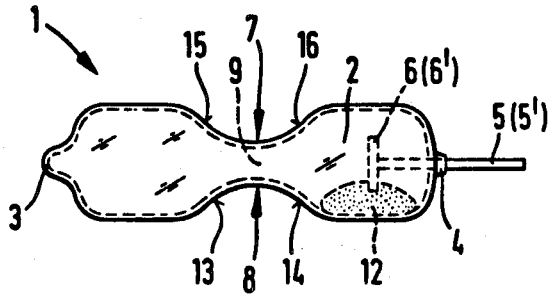
FIGS. 1, 2 and 3 are, respectively, a side elevational, perspective and plan view of a preferred embodiment of a mercury switch according to the invention.

The illustrated switch 1 is composed of a tubular glass housing, or envelope, 2 whose ends 3 and 4 are each sealed by fusing them shut. In the illustrated embodiment a pair of electrodes 5 and 5' defining an on-off switch has been fused into end 4. In a known manner, the electrodes comprise an alloy which can bond to the glass of the envelope, for instance an alloy containing 50% iron, 47.5% Nickel, 1% Chromium, 1% Manganese, and at their inside ends they are provided with contact pieces, or terminals, 6, 6' which extend transversely of the tube length.

The mercury electrode switch according to the invention has two indentations 7 and 8 which are arranged to face one another so that the envelope is pinched from opposite sides while leaving a passage gap 9 in the glass housing 2.

Figure 3:
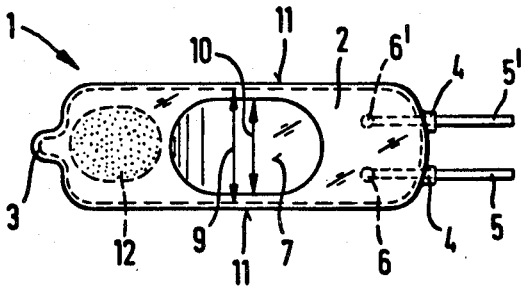

FIG. 3 shows that each indentation has an oval shape when seen in the plane of FIG. 3 with their smaller diameter 10 extending to the nonconstricted edges 11 of the glass housing 2. In this way the passage gap 9 is made quite wide and this assures that the mercury 12 can flow easily therethrough. It need not be feared that the mercury will get stuck in this gap because of the considerable width and total cross-sectional area of the gap.

Figure 2:
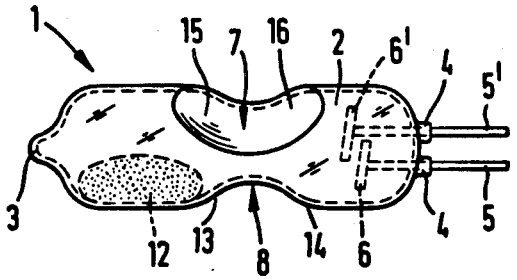

FIG. 2 shows most clearly that the indentations 7 and 8 have the shape of a trough whose oblique faces 13, 14, 15 and 16 all have the same slope relative to the longitudinal axis of envelope 2. This relationship assures that the tilt angle, measured as the angular deviation from the horizontal, is the same for the performance of every switching process. The value of the respective slope determines, of course, the absolute value of the tilt angle and thus also the magnitude of the switching hysteresis.

It will be understood that the above description of the present invention is susceptible to various modifications, changes and adaptations, and the same are intended to be comprehended within the meaning and range of equivalents of the appended claims.

What is claimed is:

1. In a mercury switch composed of a closed tubular glass envelope and at least one pair of electrodes extending through one end of the envelope and presenting terminals located within the region enclosed by the envelope and adjacent the one end thereof, the improvement wherein said envelope is formed to have two indentations located opposite one another, spaced from the ends of said envelope, and spaced at a greater distance than said terminals from said one end, said indentations projecting toward one another to define, within the region enclosed by said envelope, a gap for the passage of mercury between the ends of such region, and wherein said terminals are spaced apart in the direction of a plane which is disposed between said indentations and which is perpendicular to the direction in which said indentations project.

2. Switch as defined in claim 1 wherein the width of said gap transverse to the direction in which said indentations project is substantially equal to the internal diameter of said envelope outside of the region of said indentations.

3. Switch as defined in claim 1 or 2 wherein each said indentation has an approximately oval outline with its narrower diameter transverse to the direction between said ends of said envelope.

4. Switch as defined in claim 3 wherein each said indentation has the form of a trough with sloping sides which slope away from the interior of said envelope toward respective ends thereof, with the two sloping sides of both said indentations having the same inclination to an axial line extending between the ends of said envelope.

5. Switch as defined in claim 1 or 2 wherein each said indentation has the form of a trough with sloping sides which slope away from the interior of said envelope toward respective ends thereof, with the two sloping sides of both said indentations having the same inclination to an axial line extending between the ends of said envelope.

6. Switch as defined in claim 1, wherein said indentations are arranged to provide said gap with a width and total cross sectional area, each being transverse to the direction of flow of the mercury, which are sufficient to assure easy flow of the mercury through said gap in both directions.

* * * * *